US006639164B2

(12) United States Patent
Wang

(10) Patent No.: US 6,639,164 B2
(45) Date of Patent: Oct. 28, 2003

(54) SWITCH HAVING DEPRESSIBLE MEMBER

(75) Inventor: Pai-Shan Wang, Tainan Hsien (TW)

(73) Assignee: Shin Chin Industrial Co., Ltd., Tainan Hsien (TW)

( * ) Notice: Subject to any disclaimer, the term of this patent is extended or adjusted under 35 U.S.C. 154(b) by 36 days.

(21) Appl. No.: 09/984,468

(22) Filed: Oct. 30, 2001

(65) Prior Publication Data

US 2002/0053503 A1 May 9, 2002

(51) Int. Cl.[7] ..... H01H 3/42

(52) U.S. Cl. ..... 200/524

(58) Field of Search ..... 200/524

(56) References Cited

U.S. PATENT DOCUMENTS 4,877,931 A * 10/1989 Kawase et al. ..... 200/524 X
5,369,237 A * 11/1994 Mejerl et al. ..... 200/524
5,841,085 A * 11/1998 Rittinghaus et al. .... 200/524 X

FOREIGN PATENT DOCUMENTS

DE 3719636 A1 * 12/1988 ..... 200/524 X

* cited by examiner

*Primary Examiner*—Renee Luebke
(74) *Attorney, Agent, or Firm*—Rosenberg, Klein & Lee

(57) ABSTRACT

A switch has a base and a depressable member up-and-down movably received in the base. The base has conductive rods passed through the bottom; each having a first contact facing a respective one of second contacts of a bottom of the depressable member and a lower part sticking out for connection with a socket. A fixing hook has a lower portion held in position on an elongated slot of the base bottom, a leaning portion connected to one end of the lower portion, and an engaging portion connected to the upper end of the leaning portion. The depressable member further has an engaging surface facing the engaging portion for disengagably engaging the hook engaging portion. The depressable member is normally biased up to a power-off position by a spring positioned on the lower position of the hook. When the depressable member is depressed for the engaging portion to engage a power-on spot of the engaging surface for locking same in a power-on position; the spring will press the lower portion of the hook, causing the leaning portion to lean further forwards so as to cause the engaging portion to sufficiently abut the engaging surface.

4 Claims, 6 Drawing Sheets

SWITCH HAVING DEPRESSIBLE MEMBER

BACKGROUND OF THE INVENTION

The present invention relates to a switch, and more particularly, to a switch having a movable member, which is depressed for the start or stop of the flow of electricity.

Referring to FIGS. 1, and 2, a conventional switch includes a depressible member 15, a fixing hook 13, a propping plate 12, and a base 11. The base 11 has a bottom part 111, an annular wall 112, a holding room 113 defined by the annular wall 112, and a positioning trench 114 formed on an inner side of the wall 112 to communicate with the holding room 113. The holding room 113 has an upper opening. At least two conductive rods 14 are firmly passed through the bottom part 111, each having an upper portion received in the holding room 113 and a lower portion sticking out from the bottom part 111 for connection to a socket.

The propping plate 12 includes a frame 121, and a propping protrusion 122 having a sloping surface. The frame 121 is firmly fitted into the positioning trench 114 with the propping protrusion 122 facing the holding room 113. The fixing hook 13 has an elongated portion (not numbered) connected to the plate 12, and an engaging part 131 positioned on the sloping propping protrusion 122 to the plate 12; thus, the engaging part 131 sticks out into the holding room 113.

The depressible member 15 includes a main body 151, a spring 152 connected to a lower part of the main body 151, conductive elements 153 connected to the main body 151, and a button 154 connected to the top of the main body 151. An engaging board 16 is secured to one side of the main body 151. The main body 151 is up and down movably passed into the holding room 113 with the engaging board 16 facing the fixing hook 13, and with the spring 152 being located on the upper side of the bottom part 111 to bias the same upwards. The engaging board 16 has an engaging surface 161, which is formed with a lower stopped block 162, an upper guiding block 163 above the lower block 162, and a guiding trench 164 surrounding both the lower and upper blocks 162, 163. The guiding trench 164 includes a power-off area 166, which is below the lower stopped block 162, and a power-on sport 165, which is right above the upper part of the stopped block 162.

The spring 152 normally biases the main body 151 up to a power-off position where the conductive elements 153 are kept away from the upper portions of the conductive rods 14, and the engaging part 131 of the fixing hook 13 is received in the power-off area 166 of the guiding trench 164. When the user depresses the depressible member 15 from the button 154 so as to cause the conductive elements 153 to come into contact with the upper portions of the conductive rods 14, the engaging board 16 is moved relative to the fixing hook 13 so as to cause the engaging part 131 to move between the lower stopped block 162 and the upper guiding block 163 due to the guiding trench 164. Thus, the engaging part 131 of the hook 13 will be located on the power-on spot 165, and will engage the lower stopped block 162 to stop the main body 151 of the depressible member 15 from moving upwards when the user stops depressing the button 154. Therefore, the conductive elements 153 of the depressible member 15 are kept in contact with the conductive rods 14 for allowing the flow of electricity.

Similarly, to cut off the electricity, the button 154 is depressed for the engaging board 16 to move relative to the fixing hook 16 so as to cause the engaging part 131 to move out of the power-on spot 165 of the guiding trench 164. Thus, the engaging part 131 will be received in the power-off area 166 when the user stops depressing the button 154, allowing the spring 152 to bias the depressible member 15 upwards to the power-off position.

However, the switch is found to have a drawback that in order for the engaging part 131 of the fixing hook 13 to abut the trench 164 of the engaging board 16, the switch needs an additional component, i.e. the propping plate 12 for connection to the fixing hook. Consequently, the assembly would cost more labor and time.

SUMMARY OF THE INVENTION

Therefore, it is a main object of the present invention to provide a switch having a member depressible for starting the flow of electricity, which has less complicated structure and can be assembled with less labor.

The switch of the present invention includes a base, several conductive rods, a fixed hook, and a depressible member.

The base has a first bottom part, and an annular wall defining a holding room having an upper opening. The bottom part has insertion holes formed therein.

The conductive rods are each passed through one of the insertion holes with a first contact being positioned in the holding room and with a lower part sticking out for connection to a socket.

The fixing hook is positioned in the holding room, and has a lower secured portion positioned adjacent to the first bottom part. The fixing hook further has an upper engaging portion and an interposed portion connected to both the engaging portion and the secured portion; the interposed portion is arranged close to the annular wall, and leans forward, so as to position the engaging portion in the holding room.

The depressible member is up-and-down movably received in the holding room, and has second contacts each facing a respective one of the first contacts. The depressible member is biased up to a power-off position by a spring positioned between the secured portion and a lower part thereof. In the power-off position, the second contacts are kept away from the first contacts. The depressible member has an engaging surface facing the engaging portion of the hook for disengagably engaging the engaging portion so. Thus, the depressible member can be fixed in a power-on position when it is depressed from the power-off position, causing the second contacts to get into contact with the first contacts.

In addition, the base has a protruding portion projecting down from the first bottom part. The protruding portion has a slot on a bottom, and upper and lower securing blocks projecting out into the slot. The hook secured portion is positioned in the slot, and held in position by the upper and the lower securing blocks so as to be able to bend when the depressible member is depressed and cause the spring to press the secured portion. Therefore, the leaning interposed portion of the hook can lean further forward, and the engaging portion can move further into the holding room to abut the engaging surface.

Thus, the fixing hook doesn't need an additional propping element like that of the conventional switch.

BRIEF DESCRIPTION OF THE DRAWINGS

The present invention will be better understood by reference to the accompanying drawings, wherein.

DETAILED DESCRIPTION OF THE PREFERRED EMBODIMENT

Figure 1:
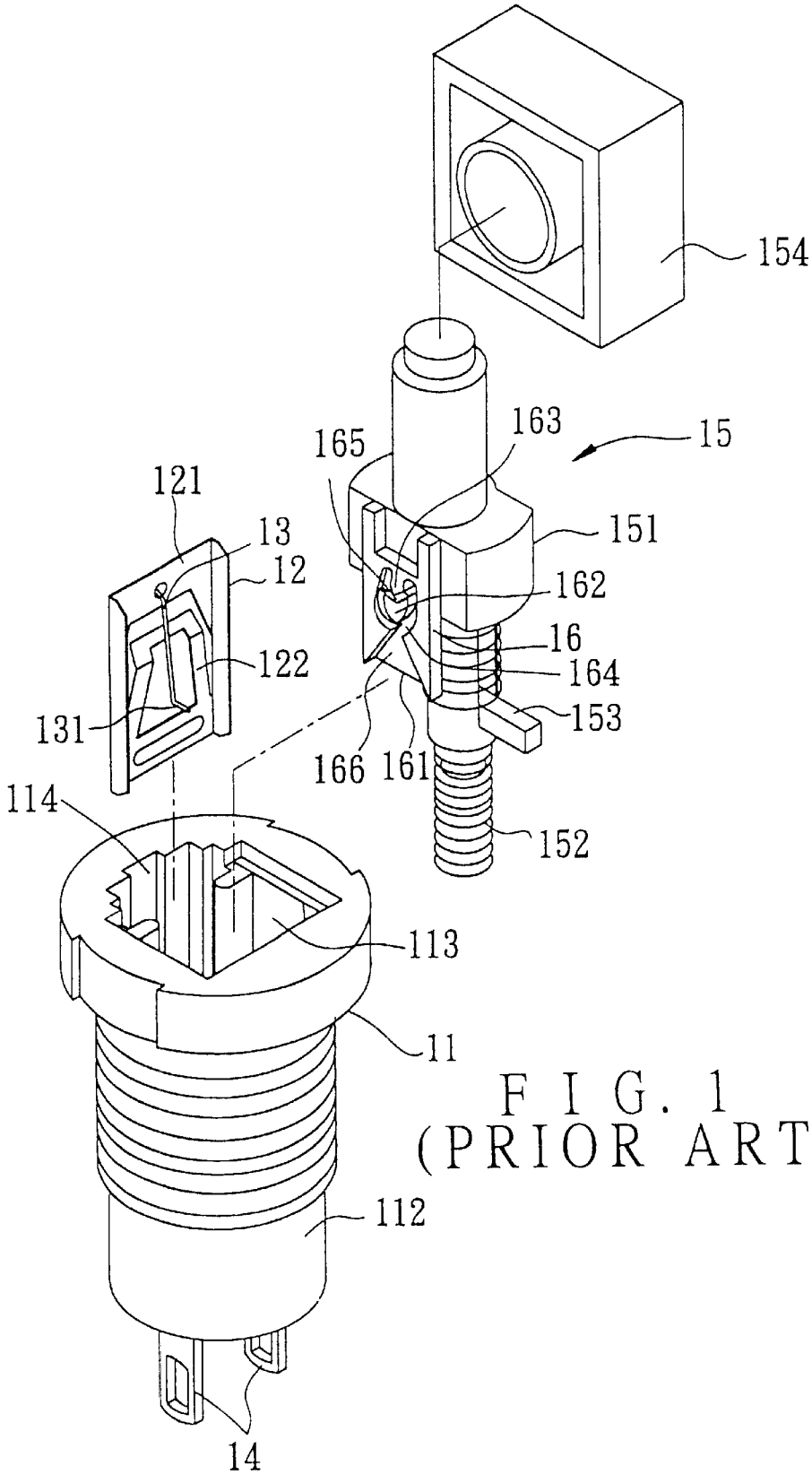
FIG. 1 (PRIOR ART)
FIG. 1 is an exploded perspective view of the conventional switch discussed in the Background.
Figure 2:
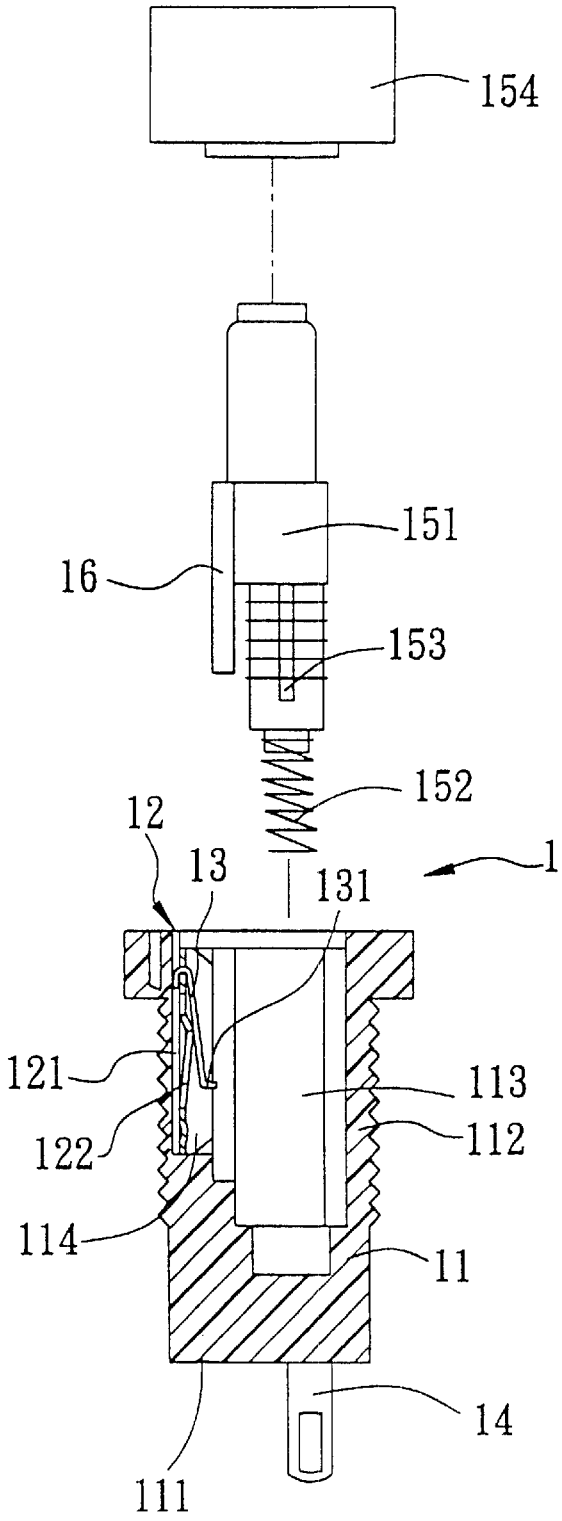
FIG. 2 (PRIOR ART)
FIG. 2 is an exploded sectional view of the conventional switch of FIG. 1.
Figure 3:
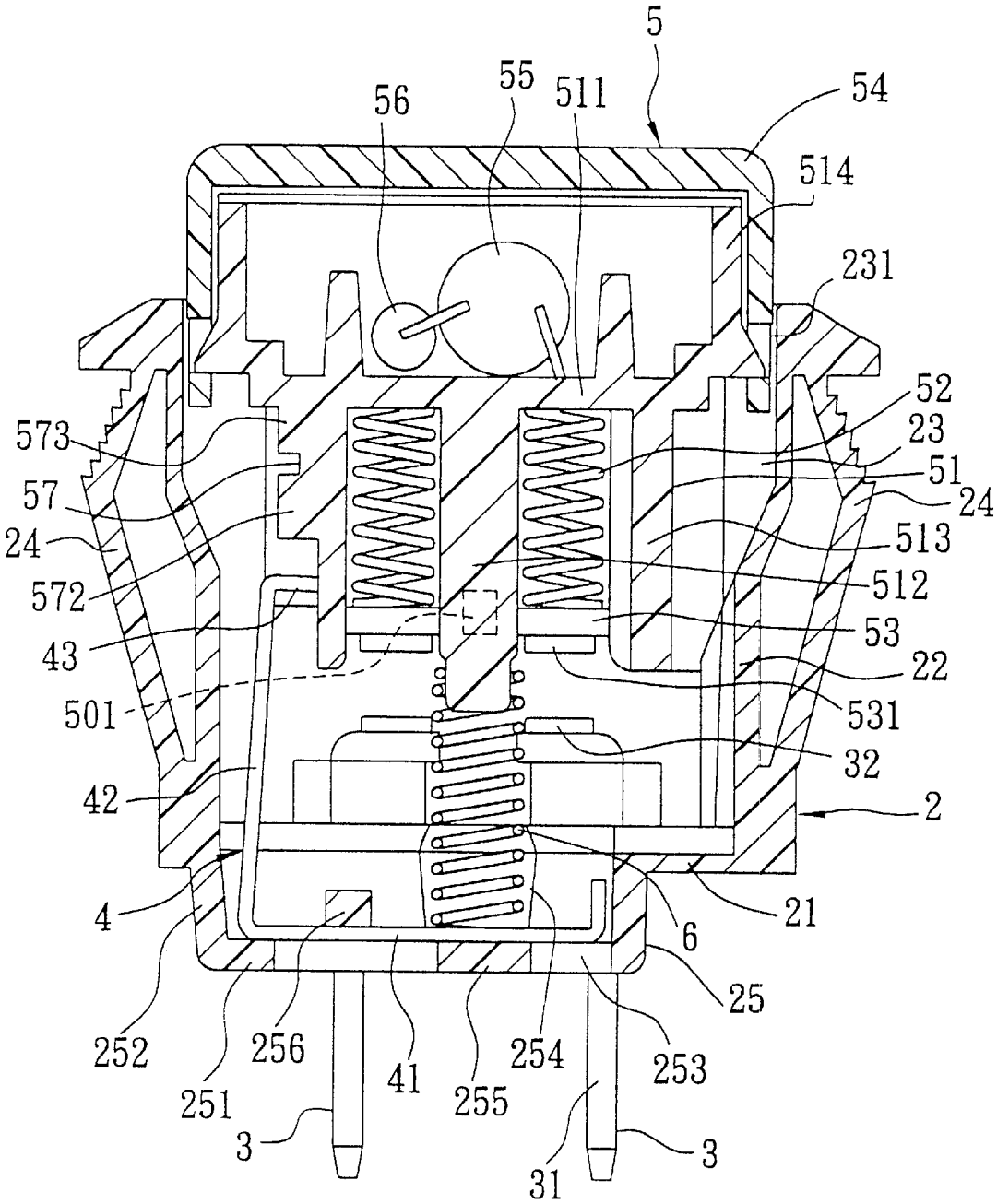
FIG. 3 is sectional view of the switch of the present invention in the power-off position.
Figure 4:
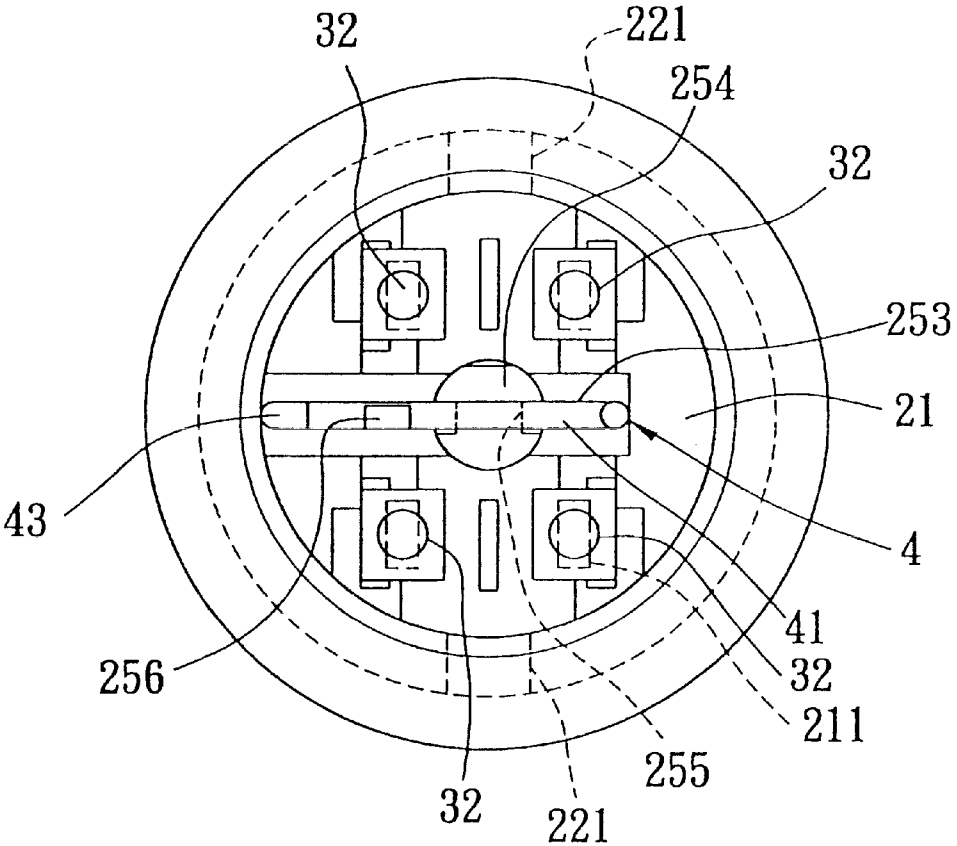
FIG. 4 is a top view of the base combined with the fixing hook of the switch according to the present invention.
Figure 7:
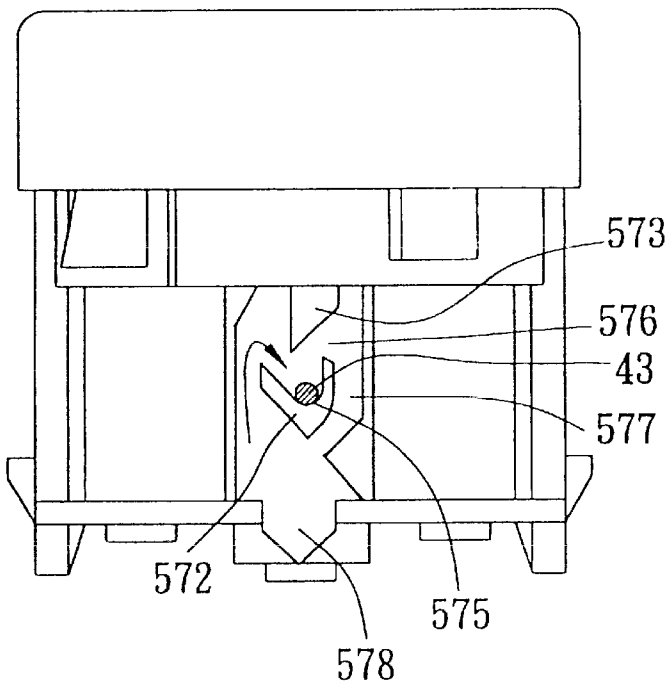
FIG. 7 is a view of the engaging surface of the switch of the present invention, and the engaging portion in the power-on spot.

Referring to FIGS. 3 and 4, a switch having a depressible member of the present invention includes a base 2, four conductive rods 3, a fixing hook 4, the depressible member 5 and a first spring 6.

The base 2 has a first bottom part 21, and an annular wall 22 perpendicular the bottom part 21. The annular wall 22 defines a holding room 23 having an upper opening 231. The base is formed with two opposing connecting wings 24 on the outer side for connection thereof to other objects. The annular wall 22 is further formed with two guide trenches 221 extending vertically from the top to the lower part of the inner side. The guide trenches 221 are preferably interposed between the wings 24.

A protruding portion 25 is formed on the lower side of the first bottom part 21 of the base 2. The protruding portion 25 includes a surrounding wall 252 connected to the first bottom part 21, and a second rectangular bottom part 251 connected to the lower end of the surrounding wall 252. The rectangular bottom part 251 has an elongated slot 253 lengthwise formed thereon. An upper securing block 256 is formed on the upper part of the rectangular bottom part 251, and projects out into the elongated slot 253, while a lower securing block 255 is formed on the lower part of the rectangular bottom part 251 to project out into the slot 253. A pair of opposing locating recesses 254 are formed on the inner sides of the surrounding walls 252 right in the center of the first bottom part 21, and communicates with the slot 253 such that the lower part of the first spring 6 can be securely received between the opposing recesses 254. The first bottom part 21 is further formed with two pairs of parallel insertion holes 211; the distances from the center of the first bottom part 21 to the insertion holes 211 are the same; and, all the insertion holes 211 point in the same direction.

The conductive rods 3 each has a lower part 31, and a first contact 32, and are each passed through a respective one of the insertion holes 211 with the first contact 32 being received in the holding room 23, and the lower part 31 projecting out from the bottom part 21 for connection to a socket.

The fixing hook 4 includes a lower secured portion 41, an upper engaging portion 43, and a sloping portion 42 between the portions 41 and 43. The lower secured portion 41 is lengthwise positioned on the elongated slot 253, and is held in position by the securing blocks 255, 256, and one end of the rectangular bottom part 251. The sloping portion 42 is bent to slightly lean forward so as to allow the engaging portion 43 to be closer to the center of the holding room 23.

Figure 5:
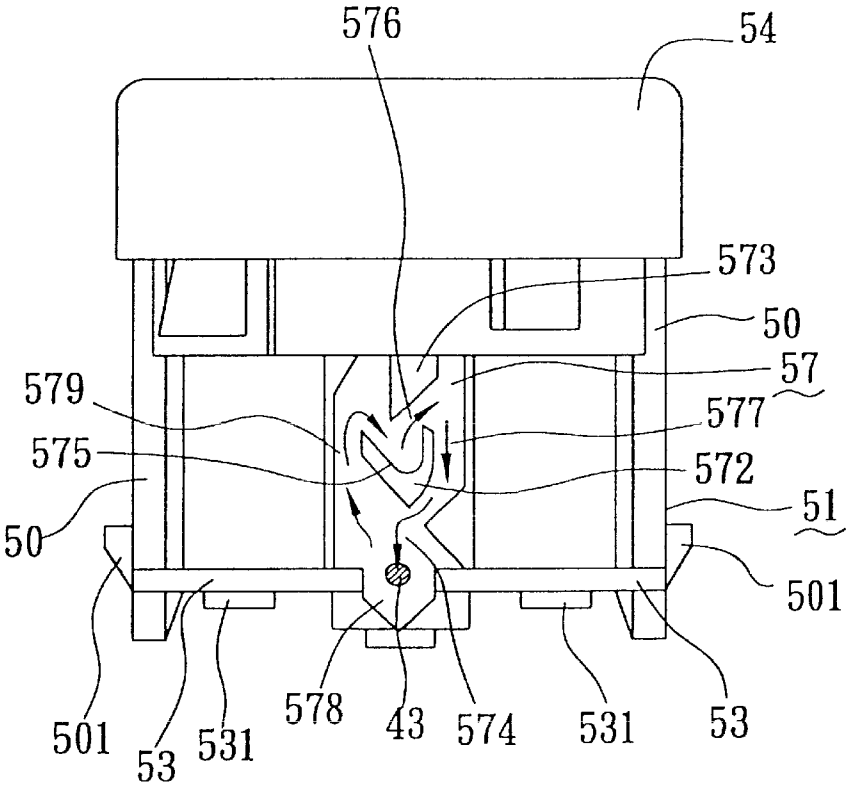
FIG. 5 is a view of the engaging surface of the switch of the present invention, and the engaging portion of the hook in the power-off area.
Figure 6:
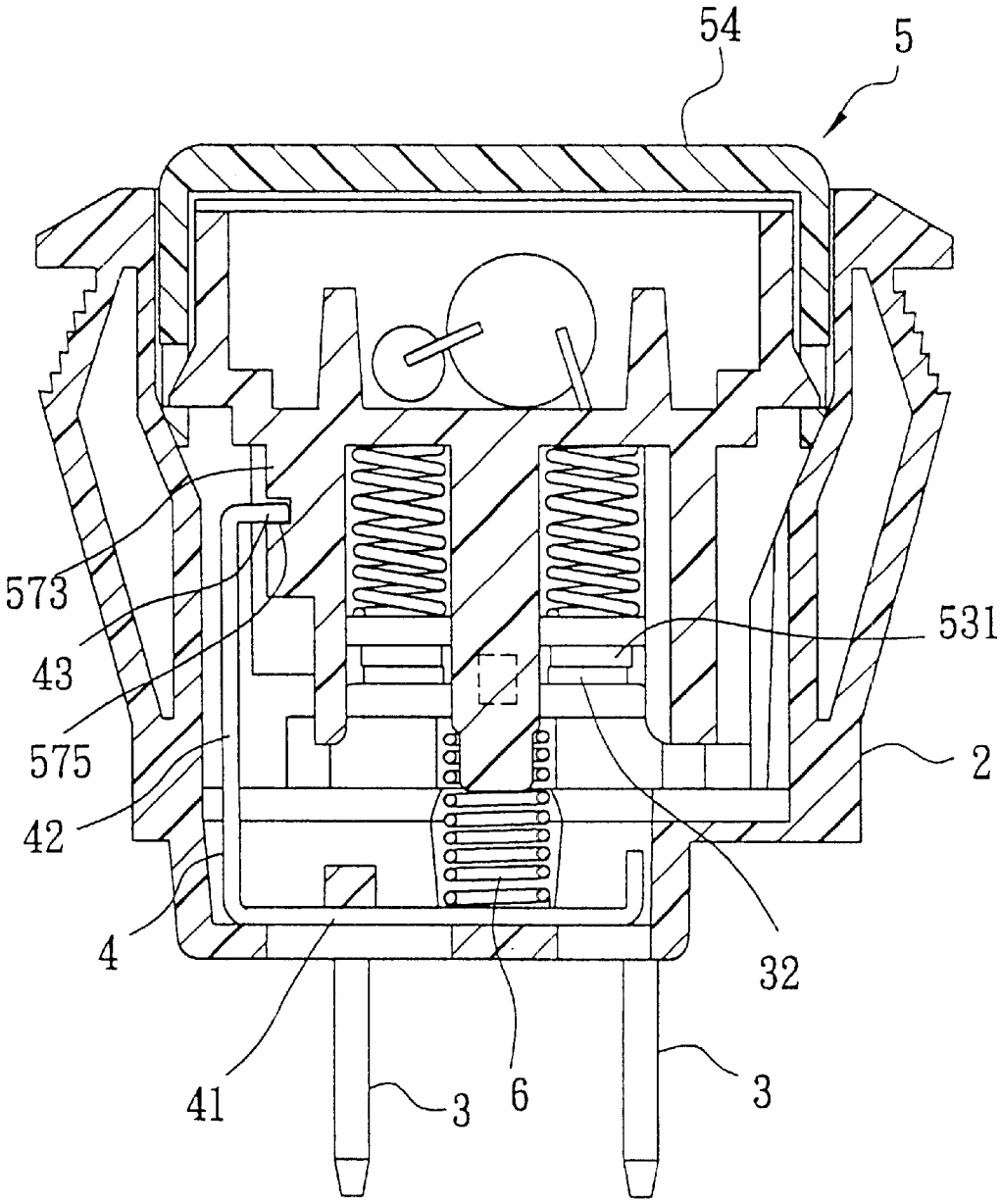
FIG. 6 is a sectional view of the switch of the present invention in the power-on position.

Referring to FIGS. 3 and 5, the depressible member 5 includes a main body 51, pushing springs 52, contact boards 53, and a button 54. The main body 51 has a middle horizontal portion 511, from which an annular protrusion 514 projects upwards, and two opposing lateral walls 513 extend down. The main body 51 further has two board-shaped parts 50 extending down from the horizontal portion 511 and between the lateral walls 513. The board-shaped parts 50 are each formed with a guided block on the lower part of the outer side thereof. A locating protrusion 512 extends down from the center of the horizontal portion 511.

The pushing springs 52 are positioned between the central locating protrusion 512 and the opposing walls 513. The contact boards 53 are each connected to the lower end of a respective one of the pushing springs 52. The contact boards 53 each further has a second contact 531 on the lower side. The button 54 is mounted on the annular protrusion 514 for connection to the main body 51. The depressible member 5 is up-and-down movably passed into the holding room 23 with the second contacts 531 each facing a respective one of the first contacts 31 of the conductive rods 3, and with the lower end of the central locating protrusion 512 being connected to the upper end of the first spring 6. The guided blocks 501 each are movably received in one of the guide trenches 221 of the base annular wall 22. Furthermore, a resistor 56, and an indicating lamp 55, are received between the button 54 and the horizontal portion 511, and electrically connected to the contact boards 53 for indicating whether the flow of electricity is started.

Referring specifically to FIG. 5, an engaging surface 57 is formed on a lateral side of the main body 51. The engaging surface 57 faces both the engaging portion 43 and the sloping portion 42 of the fixing hook 4, and has a lower stopped block 572, an upper guiding block 573 above the lower block 572, and a guiding trench 574 surrounding both the lower and the upper blocks 572 and 573. The guiding trench 574 includes a power-off area 578, which is below the lower stopped block 572, and a power-on spot 575, which is right above the upper part of the lower stopped block 572. The guiding trench 574 can be further divided into a first guiding section 576 adjacent to the sloping edge of the upper guiding block 573, a second guiding section 577 adjacent to the right edge of the stopped block 572, and a third guiding section 579 adjacent to the left edge of the stopped block 572.

The first spring 6 normally biases the depressible member 5 up to a power-off position where the second contacts 531 are kept away from the first contacts 31, and where the engaging portion 43 of the fixing hook 4 is received in the power-off area 578 of the guiding trench 574. When the user depresses the button 54 so as to cause the second contacts 531 to come into contract with the first contacts 32, the engaging surface 57 is moved down relative to the engaging portion 43 so as to cause the engaging portion 43 to move between the lower stopped block 572 and the upper guiding block 573. Thus, the engaging portion 43 will be located on the power-on spot 575 to engage the stopped block 572 and stop the main body 51 from moving upwards when the user stops depressing the button 54. Therefore, the second contacts 531 are kept in contact with the first contacts 32 of the conductive rods 3 for allowing the flow of electricity. Above all, when the depressible member 5 is depressed, the first spring 6 under pressure will cause the secured portion 41 of the fixing hook 4 abutting the lower end of the same to bend such that the engaging portion 43 can be moved further into the holding room 23 to sufficiently contact the engaging surface 57.

Similarly, to cut off the electricity, the button 54 is pressed down from the power-on position for the engaging surface 57 to move down relative to the engaging portion 43 so as to cause the engaging portion 43 to move along the first guiding section 576 of the trench 574 to separate from the power-on spot 575. Thus, the engaging portion 43 will abut the power-off area 578 when the user stops depressing the button 54 to allow the first spring 6 to bias the member 5 upwards to the power-off position.

When the depressible member 5 is moved up and down, the guided trenches 221 of the base annular wall 22, in which the guided blocks 501 of the member 5 are received, will help the depressible member 5 move smoothly-without undesirable deviation.

From the above description, it can be seen that the fixing hook 4 is directly positioned in the base 2 without the use of an additional propping element. Both the configuration of the sloping portion 42 of the hook 4 and the downward movement of the depressible member 5 can help the engaging portion 43 to sufficiently abut the power-on spot 575 of the engaging surface 57. Thus, the switch of the present invention has few components and requires less labor for assembly as compared with conventional switches.

What is claimed is:

1. A switch comprising:

a base having a first bottom part, and an annular wall formed on said first bottom part; said annular wall defining a holding room having an upper opening; said first bottom part having at least two insertion holes therein;

conductive rods each being passed through one of said insertion holes with a first contact being received in said holding room and with a projecting lower part for connection to a socket;

a fixing hook positioned in said holding room; said fixing hook having a lower secured portion positioned adjacent to said first bottom part of said base; said fixing hook having an upper engaging portion and an interposed portion connected to both said engaging portion and said lower secured portion; said interposed portion being arranged close to said annular wall and leaning forward so as to position said engaging portion in said holding room;

a depressible member; said depressible member being up-and-down movably received in said holding room of said base; said depressible member having second contacts each facing a respective one of said first contacts of said conductive rods; said depressible member being biased by a spring relative to said secured portion of said fixing hook to a power-off position where said second contacts are kept away from said first contacts; said depressible member having an engaging surface on a lateral side for disengagably engaging said engaging portion of said fixing hook so as to be fixed in a power-on position when said depressible member is pressed down from said power-off position to cause said second contacts to get into contact with said first contacts; said secured portion of said fixing hook being deflectably engaged by said spring to responsively bias said engaging portion against said depressible member.

2. The switch as claimed in claim 1, wherein said base has a rectangular protruding portion projecting down from said first bottom part; said lower secured portion of said fixing hook being lengthwise positioned on a second bottom part of said rectangular protruding portion.

3. A switch comprising:

a base having a first bottom part, and an annular wall formed on said first bottom part; said annular wall defining a holding room having an upper opening; said first bottom part having at least two insertion holes therein; said base having a rectangular protruding portion projecting down from said first bottom part;

conductive rods each being passed through one of said insertion holes with a first contact being received in said holding room and with a projecting lower part for connection to a socket;

a fixing hook positioned in said holding room; said fixing hook having a lower secured portion positioned adjacent to said first bottom part of said base; said fixing hook having an upper engaging portion and an interposed portion connected to both said engaging portion and said lower secured portion; said interposed portion being arranged close to said annular wall and leaning forward so as to position said engaging portion in said holding room; said lower secured portion of said fixing hook being lengthwise positioned on a second bottom part of said rectangular protruding portion; and a depressible member; said depressible member being up-and-down movably received in said holding room of said base; said depressible member having second contacts each facing a respective one of said first contacts of said conductive rods; said depressible member being biased by a spring relative to said secured portion of said fixing hook to a power-off position where said second contacts are kept away from said first contacts; said depressible member having an engaging surface on a lateral side for disengagably engaging said engaging portion of said fixing hook so as to be fixed in a power-on position when said depressible member is pressed down from said power-off position to cause said second contacts to get into contact with said first contacts;

wherein said rectangular protruding portion has a surrounding wall connected to said first bottom part; said surrounding wall being formed with two opposing recesses for allowing a lower end of said spring to be securely received therebetween.

4. A switch comprising:

a base having a first bottom part, and an annular wall formed on said first bottom part; said annular wall defining a holding room having an upper opening; said first bottom part having at least two insertion holes therein; said base having a rectangular protruding portion projecting down from said first bottom part;

conductive rods each being passed through one of said insertion holes with a first contact being received in said holding room and with a projecting lower part for connection to a socket;

a fixing hook positioned in said holding room; said fixing hook having a lower secured portion positioned adjacent to said first bottom part of said base; said fixing hook having an upper engaging portion and an interposed portion connected to both said engaging portion and said lower secured portion; said interposed portion being arranged close to said annular wall and leaning forward so as to position said engaging portion in said holding room; said lower secured portion of said fixing hook being lengthwise positioned on a second bottom part of said rectangular protruding portion; and a depressible member; said depressible member being up-and-down movably received in said holding room of said base; said depressible member having second contacts each facing a respective one of said first contacts of said conductive rods; said depressible member being biased by a spring relative to said secured portion of said fixing hook to a power-off position where said second contacts are kept away from said first contacts; said depressible member having an engaging surface on a lateral side for disengagably engaging said engaging portion of said fixing hook so as to be fixed in a power-on position when said depressible member is pressed down from said power-off position to cause said second contacts to get into contact with said first contacts;

wherein said second bottom part has a slot lengthwise formed thereon, and has an upper securing block and a lower securing block sticking out into said slot; said lower secured portion of said fixing hook being positioned in said slot, and below said upper block and above said lower block so as to be able to bend when said depressible member is depressed for starting flow of electricity thus causing said spring to press said lower secured portion, and causing said leaning portion of said fixing hook to lean further forwards for said engaging portion to move towards a center of said holding room to abut said engaging surface.

* * * * *